United States Patent [19]

Weidler

[11] 4,159,158

[45] Jun. 26, 1979

[54] DISPLATION CONNECTOR HAVING IMPROVED TERMINAL SUPPORTING MEANS

[75] Inventor: Charles H. Weidler, Lancaster, Pa.

[73] Assignee: AMP Incorporated, Harrisburg, Pa.

[21] Appl. No.: 859,067

[22] Filed: Dec. 9, 1977

Related U.S. Application Data

[63] Continuation-in-part of Ser. No. 794,429, May 6, 1977, abandoned.

[51] Int. Cl.[2] ..... H01R 9/08; H01R 13/38; H01R 13/42

[52] U.S. Cl. ..... 339/97 P; 339/217 S; 339/276 F

[58] Field of Search ..... 339/97–99, 339/176 M, 217 S, 276 T, 276 F

[56] References Cited

U.S. PATENT DOCUMENTS

| | | | |
|---|---|---|---|
| 3,380,013 | 4/1968 | Krone et al. | 339/97 P |
| 3,609,644 | 9/1971 | Seim | 339/98 |
| 3,992,072 | 11/1976 | Anhalt et al. | 339/97 P |
| 4,035,897 | 7/1977 | Over et al. | 29/760 |
| 4,074,929 | 2/1978 | Krider | 339/97 R |

*Primary Examiner*—Neil Abrams
*Attorney, Agent, or Firm*—Frederick W. Raring

[57] ABSTRACT

Multi-contact electrical connector comprises an insulating housing having terminals therein which have displation type wire-receiving portions. The terminals are of an improved simplified design and improved supporting means are provided in the housing for the terminals which permits the connector to be manufactured in small sizes. The housing is also adapted to receive crimp-type terminals.

6 Claims, 14 Drawing Figures

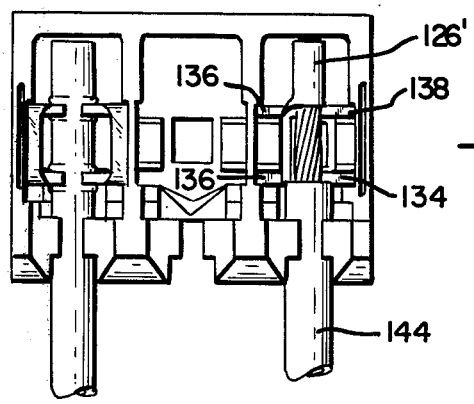
Fig. 12
Fig. 13
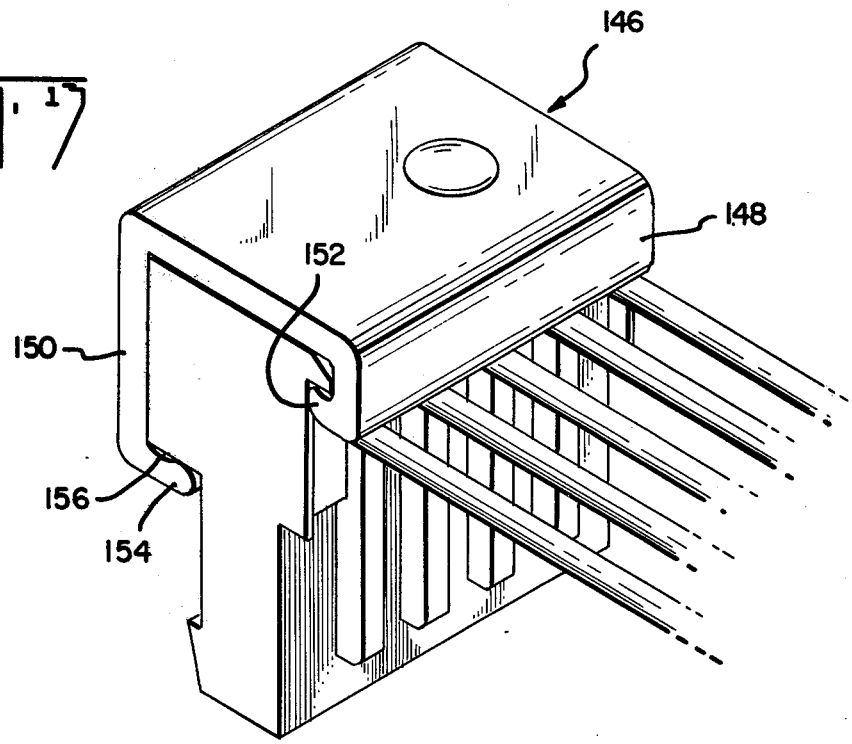

DISPLATION CONNECTOR HAVING IMPROVED TERMINAL SUPPORTING MEANS

BACKGROUND OF THE INVENTION

This application is a continuation-in-part of application Ser. No. 794,429 filed May 6, 1977, now abandoned.

This invention relates to multi-contact electrical connectors. In accordance with one aspect of the invention, a multi-contact connector is provided having improved displation type connecting means for connecting wires to the terminals in the connector. In accordance with a further aspect of the invention, a connector housing is provided which is capable of receiving either displation type contact terminals or contact terminals of the type which are crimped onto wires. The invention as herein described with reference to a connector which serves to connect individual wires to terminal posts on a circuit board or the like. However, it will be apparent that the principles of the invention can be used in other types of connectors.

The term "displation" has been coined to describe and identify electrical connections between wires and terminals in which the terminal has one or more plate-like portions which have wire-receiving slots. The dimensions of the slot are such that when the wire is moved into the slot, the opposed edges of the slot penetrate the insulation of the wire and establish electrical contact with the metallic core of the wire.

A wide variety of electrical connectors having displation type contact terminals therein have been proposed and many of these are being manufactured and used in many branches of the electrical industry. A comparative advantage of a connector having displation type contacts therein is that the connector housing can be pre-loaded with the contact terminals and the individual conductors can be connected to the terminals by a relatively simple wire insertion operation. The necessity of connecting the wires to the terminals in a crimping press or by soldering in a separate operation is avoided, as is the step of individually inserting the terminals (after they have been crimped onto the wire) into the cavities in the housing. U.S. Pat. Nos. 3,955,873, 3,760,335 and 4,009,922 show several of the types of displation type connectors which have been proposed and/or are being widely used.

When wires are inserted into the terminals of a displation type connector, substantial forces are imposed on the terminal and on the connector housing by reason of the fact that the wires must be forced into the undersized slots in the terminals. The imposition of these forces on the terminal and on the connector housing gives rise to a requirement that adequate support be provided for the terminal in the housing and the terminal itself must be sufficiently robust to withstand the forces of the wire insertion operation. Moreover, if the terminal has a contact portion which mates with a complementary terminal device, the forces imposed on the terminal and housing during insertion of the wire must be isolated from the contact portion of the terminal in order to prevent any possible damage to the contact portion. This requirement of providing sufficient support for the terminal and isolating the effects of the wire insertion operation from the contact portion of the terminal has been met in the past by a variety of connector designs. Quite often, the specific solutions to the problem have resulted in connectors which are too large for many uses and/or designs which are suitable for use in only a limited number of applications. There is, therefore, a need in the electrical industry for a displation type connector which can be manufactured in small sizes, for example, for mating with terminal posts on 0.100 centers on a panel board. Furthermore, a connector which is suitable for connecting wires to terminal posts on a panel board should be extremely low in cost because of the vast numbers of such connectors which are required in the electronics industry.

It is accordingly an object of the invention to provide an improved electrical connector having contact terminals therein with displation type connecting means for connecting the terminals to individual wires. A further object is to provide a displation type connector which is extremely uncomplicated and which can be produced in small sizes at a minimum cost. A further object is to provide an improved displation type connector for terminals which are adapted to be mated with terminal posts or terminal pins in a complementary connector. A further object is to provide a contact terminal having displation type wire connecting means and a housing for the terminal, the terminal and housing have coacting means for supporting the terminal during insertion of wires into the terminals in the housing.

As mentioned briefly above, the invention is also directed to the achievement of an electrical connector housing which is capable of accepting either displation type contact terminals of the class discussed above or terminals of the type which are crimped onto the ends of wires. There are many circumstances in which it would be highly desirable to use connectors capable of accepting either displation type contact terminals or crimp, snap-in terminals, i.e., terminals which are adapted to be crimped onto the ends of wires in a crimping press and thereafter inserted into the cavities in the connector housing.

It is accordingly an object of the invention to provide a connector housing which is capable of receiving either displation type terminals or crimped type terminals. A further object is to provide a connector installed on the ends of a plurality of wires with some of the wires connected to displation type terminals and other wires connected to crimp type terminals.

These and other objects of the invention are achieved in preferred embodiments thereof which are briefly described in the foregoing abstract, which are described in detail below, and which are shown in the accompanying drawing in which:

FIG. 1 is a perspective view showing a typical panel board having terminal posts thereof and a connector in accordance with the invention in alignment with the posts on the panel board.

FIG. 2 has a fragmentary perspective view showing a connector housing and a terminal in accordance with the invention.

FIG. 12 is a top plan view of a housing, one of the wires extending to a crimped type terminal of the type shown in FIG. 9, and the other wire extending to a displation type terminal.

FIG. 13 is a perspective view showing one form of cover for the connector of FIG. 1.

Figure 1:
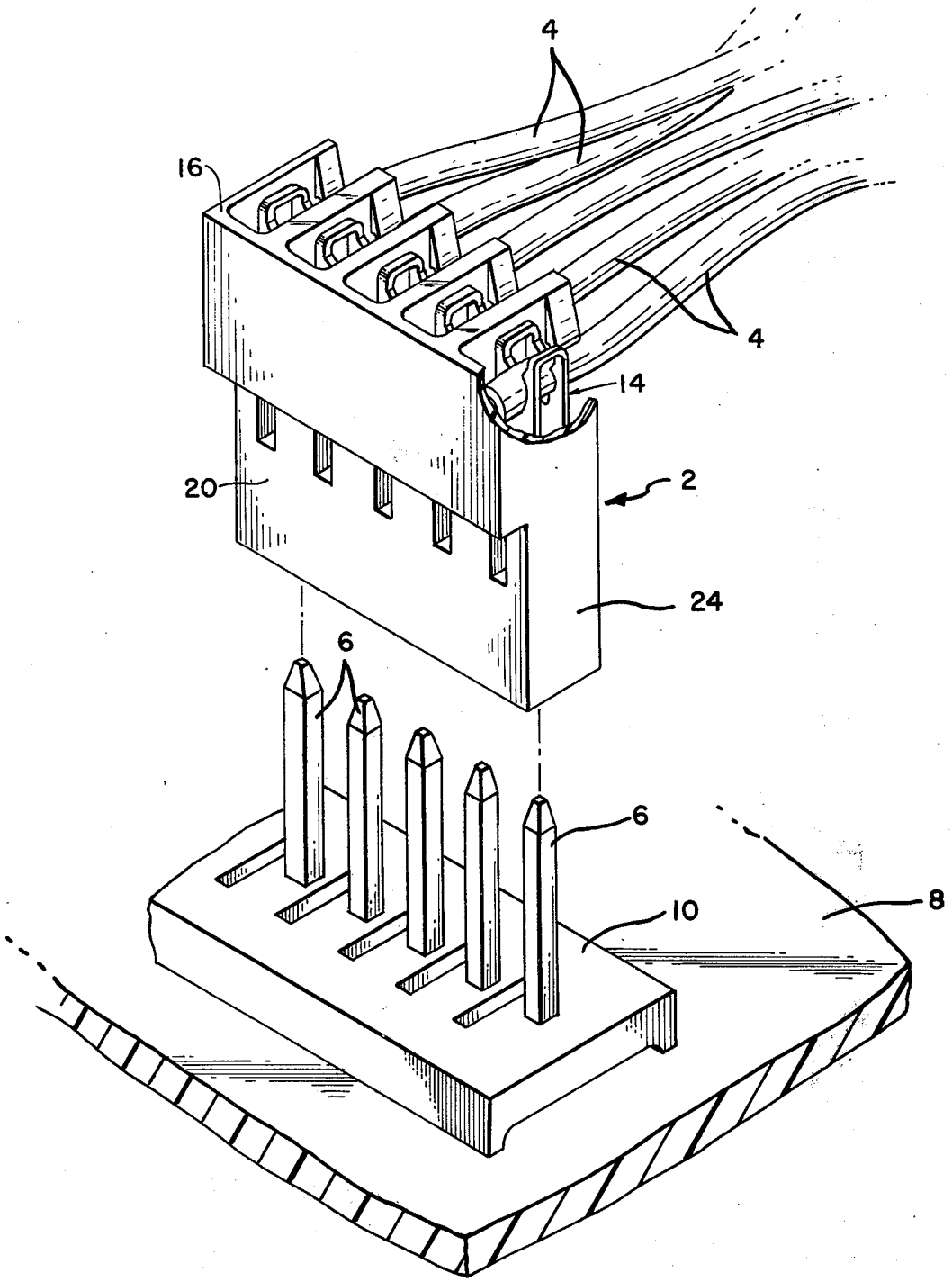

As shown in FIG. 1, one embodiment 2 of the invention comprises a connector for disengagably connecting individual wires 4 to spaced-apart terminal posts 6 which are mounted in, and extend from, a panel board 8. In FIG. 1, the terminal posts 6 extend through a header 10 which rests on the surface of the board. It is common practice to mount the posts 6 in a header 10 at the time of manufacture of the posts so that a header having a plurality of posts therein can be assembled to a panel member 8 by merely aligning the posts in the header with the holes in the panel and inserting the lower ends of the posts through the holes. The lower portions of the posts 6 may be soldered to conductors on the underside of the panel member 8 or may be connected to other conductors as by point-to-point wiring.

The connector 2 (FIG. 2) comprises an insulating housing 12 having a plurality of contact terminals 14 contained therein. The housing 12 is generally prismatic and is advantageously of nylon or other material which can be manufactured by an injection molding process. The housing has a wire-receiving face 16, an oppositely directed mating face 18, external sidewalls 20, 22, and external endwalls 24, 26. A plurality of side-by-side cavities 28 extend through the housing from the wire-receiving face to the mating face and each cavity has a wire-receiving portion 30, a transition portion 32, and a receptacle portion or post receiving portion 34 which is proximate to the mating face 18.

The wire-receiving portion 30 is somewhat enlarged relative to the receptacle portion and has first opposed internal endwalls 38, 38' which extend transversely of the external sidewalls 20, 22. As shown best in FIGS. 3 and 4, the external sidewall 20 is laterally outwardly offset adjacent to the wire-receiving face 16 and this lateral offset provides a pocket in the wire-receiving portion of each cavity above the ramp 62. The internal endwalls 38, 38' are mirror images of each other so that a description of one will suffice for both and the same reference numerals, differentiated by prime marks, will be used to identify corresponding structural features on these sidewalls. The internal sidewalls 40, 42 of the wire-receiving portion are proximate and parallel to the external sidewalls 20, 22 respectively and are not similar to each other.

The endwall 38 is generally flat and has a centrally located rib 44 which extends from the lower portion of the wire-receiving portion of the cavity towards the wire-receiving face 16. This rib is convergently tapered at its upper end 46 as viewed in FIG. 2, and provides a shoulder surface 48 which is parallel to the wire-receiving face 16 and spaced inwardly therefrom. As will be explained below, this shoulder surface 48 and the sides 47 of the rib serve to support, and maintain the position of, a terminal in the housing during insertion of a wire into the terminal. The lower portion 50 of the rib 44 is relatively wider than the upper portion and merges at shoulder 52 with, and is coplanar with, one endwall 57 of the receptacle portion 34 of the cavity. A channel or groove 43 is provided above the shoulder 52 by one side 47 of the rib 44 and the internal sidewall 42.

An additional channel or groove 54 is provided in each internal endwall beside the lower portion of the rib 44 adjacent to sidewall 56 and that this channel extends downwardly in the endwall of the receptacle portion to the lower end 74 of the cavity. The sidewalls 56, 58 of the receptacle portion are proximate to the external sidewalls 20, 22 and merge at the transition section with the internal sidewalls 40, 42 of the wire-receiving portion.

Figure 3:
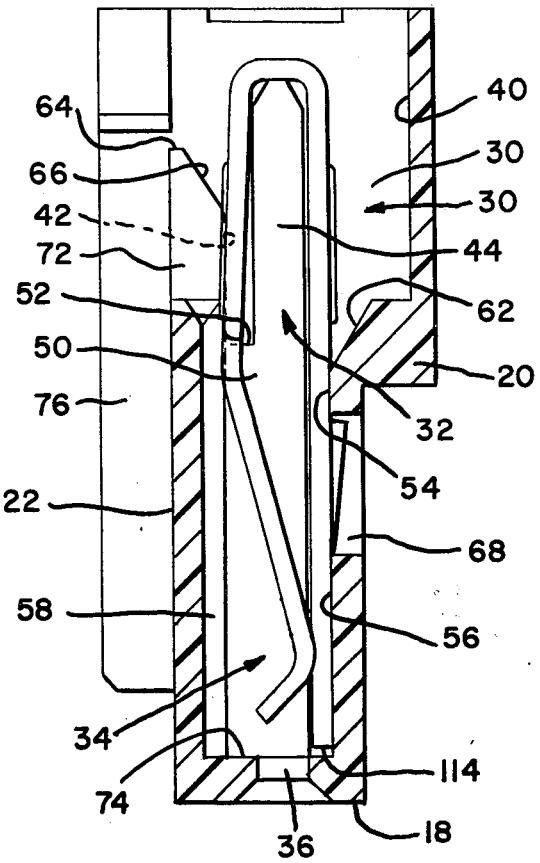
FIG. 3 is a cross-sectional view taken along the line 3—3 of FIG. 1.

The transition section 32 is defined by an upwardly facing surface 60 adjacent to the internal sidewall 40 and a ramp surface 62 which extends to the sidewall 56 of the receptacle portion. A shoulder 64 and ramp 66 are also provided on the sidewall 42 and the ramp merges with the surface 42 as shown in FIG. 3. An opening 72 is provided in the sidewall 22 for reception of the wire which is connected to the terminal as described below, the lower end of this opening 72 being coplanar with the shoulder 60 which extends from the internal sidewall 40.

External ribs which extend toward the wire-receiving face are provided on the sidewall 22 and the upper ends of these ribs are generally arrow shaped as shown at 78. The trailing edges 82 of adjacent arrow-like portions provide a constriction in the form of a one way gate which permits a wire to move downwardly into the terminal in the associated cavity but which prevent upward movement of the wire. These arrow-like members also serve as a strain relief for the wire when an upward tensile pull is applied to it.

An opening 68 is provided in the sidewall 20 and communicates with the receptacle portion 34 of the cavity. This opening receives a retention lance in the terminal and prevents upward movement of the terminal from the cavity after it has been inserted. A square post receiving opening extends through the mating face 18 and intersects the inner end 74 of the cavity as shown in FIG. 2.

The individual terminals 14 comprise essentially an elongated strip of sheet metal which is reversely folded about its midpoint to provide two contact arms 100, 102, which constitute the receptacle portion of the terminal, the two spaced-apart plate members 88, 90 which constitute the wire-receiving portion 84 of the terminal. The wire-receiving plates 88, 90 are connected by a bight comprising spaced-apart relatively narrow strap members 92, 92' between which the wire is moved when the wire is connected to the terminal. Each plate member 88, 90 has a wire-receiving slot 94 and the upper ends of these slots merge with transition ramps 96 which extend laterally obliquely to the strap members 92, 92' so that a relatively wide opening is provided in the upper end of the terminal for the wire and wire will be guided between ramps 96 into the slots 94. If desired, U-shaped embossments 98 may be provided on the plate members to strengthen and stiffen them, particularly if the terminal is produced from relatively thin stock metal.

A flat contact arm 100 extends from the plate member 88 and has a lance 106 outwardly struck therefrom for cooperation with the previously identified opening 68.

Figure 2:
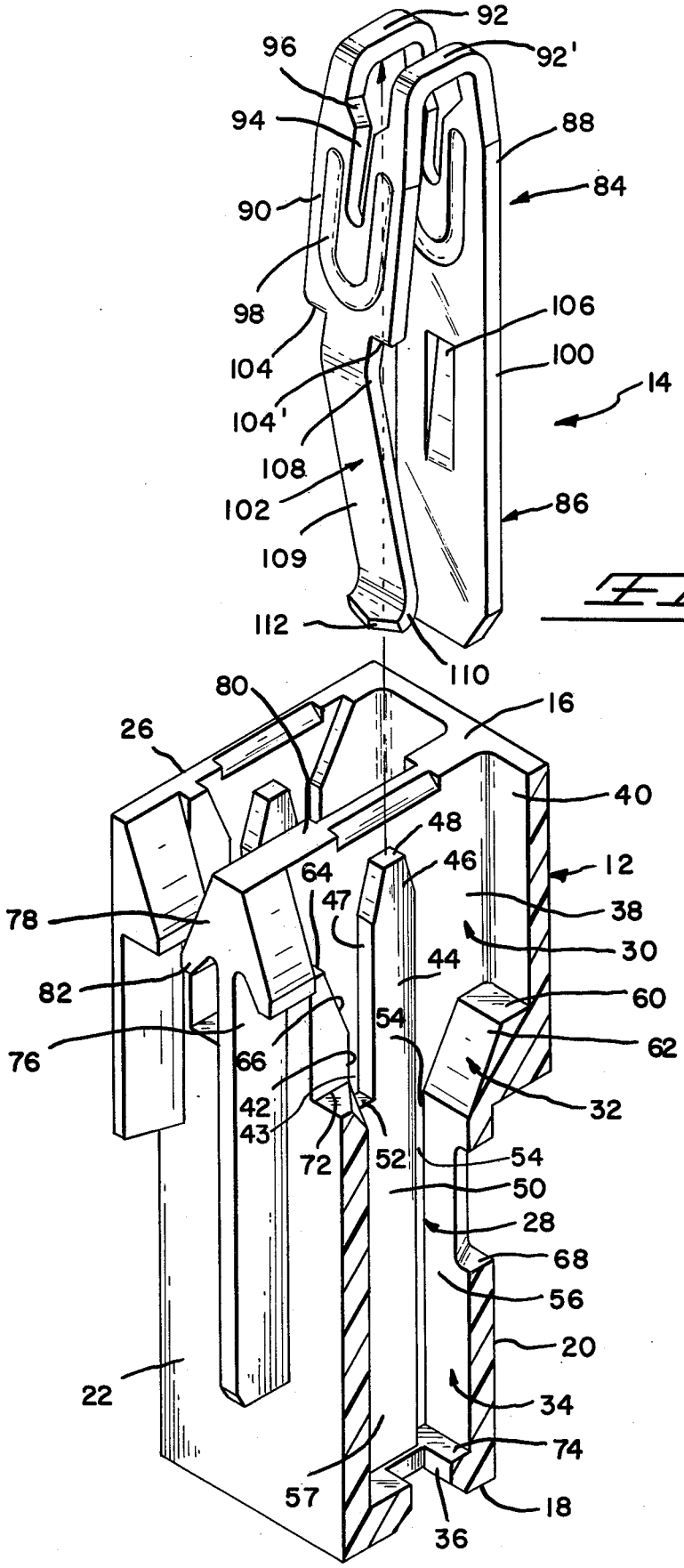

The plate member 90 normally extends slightly obliquely with reference to the plane of plate member 88 and the movable contact arm 102, which is of reduced width, extends from the lower end of plate member 90 so that downwardly facing, as viewed in FIG. 2, shoulders 104, 104' are provided.

Figure 6:
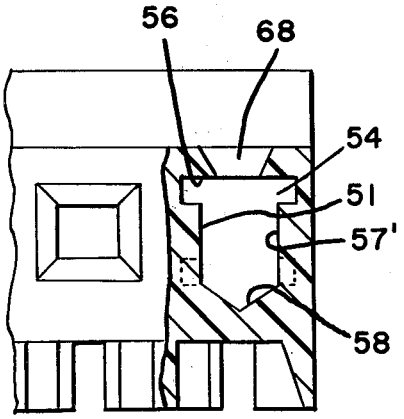
FIG. 6 is a plan view of a portion of the mating face of the housing with parts broken away to show the internal features of a housing cavity.

The arm 102 is reversely formed at 108 so that it has an elongated section 109 which extends towards the plane of the arm 100. The lower end of this arm is also reversely formed at 110 so that tip portion extends obliquely away from the plane of the arm 100. The end of the arm is bluntly pointed as shown at 112 so that it can be received in the trough-like sidewall of the receptacle portion of the cavity, see FIG. 6.

The exploded terminal 14 shown in FIG. 2 is in its normal condition as regards the location of the arm 102 relative to the arm 100. When the terminal is inserted into the housing, the arm 102 is flexed towards the arm 100 and the terminal is then moved downwardly from the position of FIG. 2 until it is fully inserted as shown in FIG. 3. The side edge portions of the arm 100 will be received within the grooves or channels 54, 54' and the end portion of the arm 102 will be guided between ramp surfaces 66, 66' into the trough-like sidewall 58 of the receptacle portion of the housing. It will be apparent that the arm 102 is, when fully inserted, prestressed and held against the surface of the contact arm 100.

The terminal is completely inserted into the cavity when the internal surfaces of the strap members 92, 92' move against the shoulders 48, 48' on the upper ends of the ribs 44, 44'. The lance 106 is flexed inwardly during insertion and snaps into the opening 68 to prevent upward movement of the terminal from the cavity. After the terminal has been fully inserted, the grooves 43, 54 in the endwalls receive marginal side edge portions of the terminal.

As shown in FIG. 3, the lower end 114 of the arm 100 is spaced from the inner end surface 74 of the housing when the terminal is fully inserted. It is advantageous to dimension the terminal and the housing cavity such that this condition will exist and to avoid dimensioning the parts such that the end 114 will bear against the surface 74. It is also desirable to dimension the parts such that the shoulders 104 of the terminal will be slightly above the shoulders 52, 52' of the housing when the terminal is fully inserted and the shoulders 48, 48' are against the downwardly facing surfaces of the strap members 92, 92'. The purpose of these relationships will be explained below.

In use, the wires 4 are connected to the terminals by simply locating the wires in alignment with the openings between the strap members 92, 92' and moving the wires downwardly until they are fully inserted into the wire-receiving slots 94 of the terminals. As explained previously, the movement of the wires into the terminals imposes substantial loads on the terminals and these loads give rise to relatively high stresses in the terminal. Since the terminals are made of thin stock metal, for example, stock metal having a thickness of about 0.012 inches, such stresses can damage the terminal unless they are properly controlled and the loading of the terminal which takes place during wire insertion can damage the receptacle portion of the terminal if these stresses are transmitted to the receptacle portion. In accordance with the principles of the instant invention, however, the downwardly directed forces imposed on the terminal as the wire moves into the slots 94 produce only isolated tensile stresses in the wire-receiving portion of the terminal, these stresses being totally contained between the strap members 92, 92' and the portions of the plate members which lie between the wire and the strap members. During insertion, a wire will impose a downwardly directed force on each of the plate members but since the shoulders 48, 48' are against the internal surfaces of the strap members, the downwardly directed forces imposed by the wires will be counteracted by the upwardly directed reaction forces developed in the strap members and tensile loading of the terminals in only the upper portions thereof will result. The receptacle portion of the terminal will be unaffected by these relatively high stresses developed in the upper portion of the terminal.

The stresses which are imposed on the wire-receiving portion of the terminal during movement of the wire into the slots are not related to the stresses which establish electrical contact between the conducting core of the wire and the opposed edges of the slots. When the wire is positioned in the slots, it flexes portions of the plate-like members on opposite sides of the slots outwardly by virtue of the fact that the wire is oversized relative to the width of the slot and it is these slots imposed on the plate members 88, 90 which establish, and maintain, electrical contact. These stresses remain in the terminal after the wire has come to rest in the slots and they must be maintained in order to maintain electrical contact. The tensional stresses discussed above are developed only during insertion of the wire and after the wire comes to rest, these tensional stresses are relieved but these temporary stresses imposed on the terminal during insertion of the wires can damage the terminal and it is to avoid such damage that the shoulders 48 are provided.

As previously explained, it is desirable to dimension the parts such that the end 114 of the arm 100 is spaced from the surface 74 of the cavity and the shoulders 104, 104' should be spaced from the shoulders 52. If these dimensional restrictions are followed, then the shoulders 48 will bear the entire load of the insertion forces. Alternatively, if the end 114 of the arm 100 is against the surface 74, the straps 92, 92' may be spaced from the surface 48 and column loading may result in the entire terminal during wire insertion. Such column loading would be highly undesirable for the reason that the arm 100 might buckle during wire insertion and be damaged or other undesirable and unforeseen effects may take place.

After insertion of the wires, they will extend laterally through the openings 72 and will bear against the pointed trailing ends of the arrow-like strain relief devices. The wires can thus be pulled upwardly without damaging the electronic connections between the wires and the wire-receiving portions of the terminals.

A significant advantage of the invention is that connector in accordance with the invention can be made in extremely small sizes and the lateral dimensions of the housing particularly in the wire-receiving portion thereof are not excessive. This feature is achieved by virtue of the fact that the individual terminals are extremely simple in shape and form and the width of the individual terminal in a wire-receiving portion is not significantly greater than the width of the same terminal in the receptacle portion as is apparent from FIGS. 3 and 4. These minimum dimensions can be maintained because of the fact that the terminal has the relatively simple U-shaped profile discussed above and the U-shaped profile can be used because of and by virtue of the support provided for the wire-receiving portion of the terminal by the shoulders 48, 48'.

Figure 4:
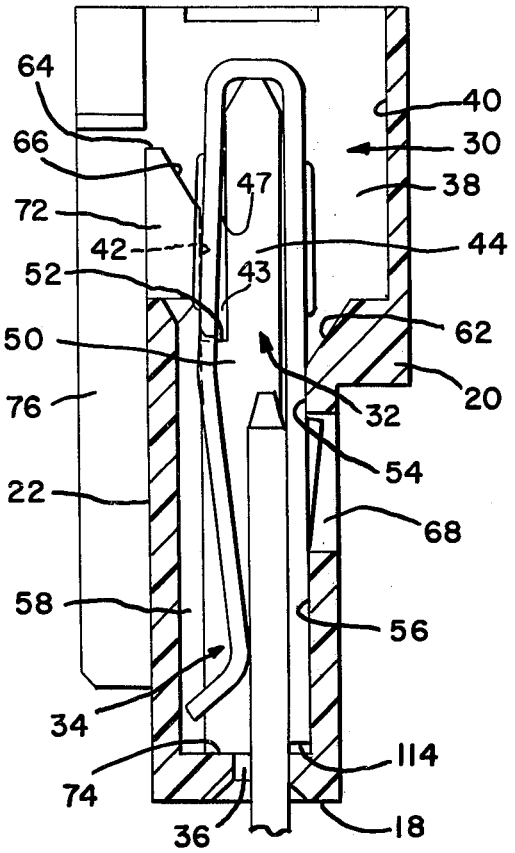
FIG. 4 is a view similar to FIG. 3 showing the connector mated with a terminal.
Figure 5:
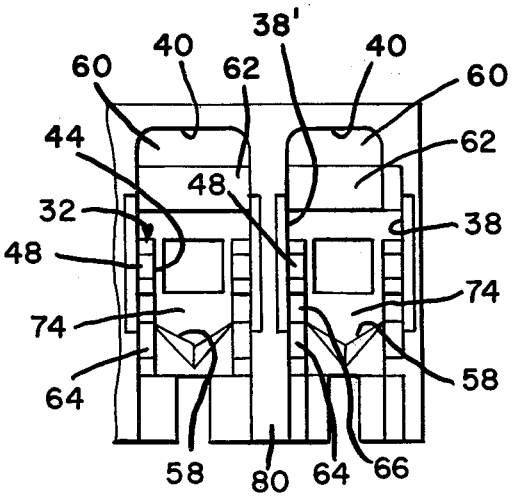
FIG. 5 is a plan view of a portion of the wire-receiving face of the connector housing.

It will be apparent from an inspection of FIGS. 3 and 4 that terminals in accordance with the invention have a relatively long spring arm 102 with relation to the overall length of the terminal, that is, the distance between the straps and the free ends of the arms 100, 102. This feature of having a relatively long spring arm is highly desirable for the reason that the contact pressure developed between cantilever spring arm can be accurately controlled during the design of the terminal and the terminal designer is, therefore, accorded a wide range of design parameters as regards metal thickness, metal temper, the amount of preloading, which can be varied as desired.

It will be apparent that a wide variety of connectors can be made in accordance with the principles of the invention and that in all cases, manufacturing costs can be maintained at a minimum level because of the relative simplicity in both the housing and the terminal.

Figure 7:
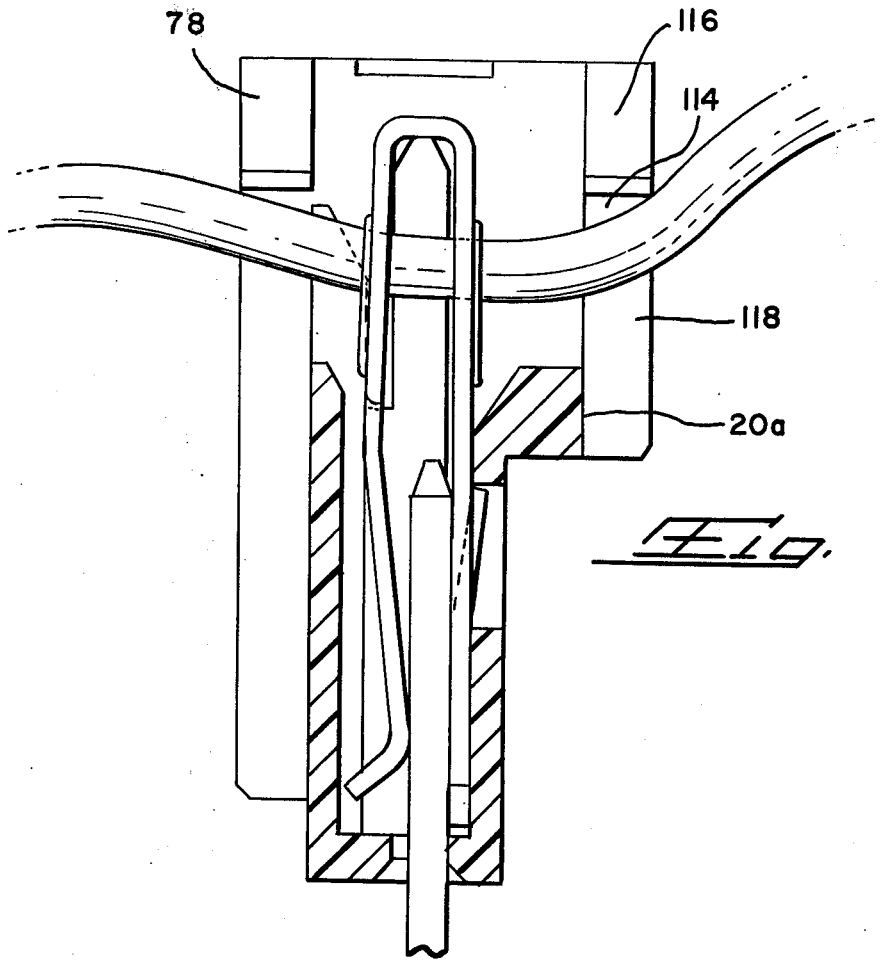
FIG. 7 is a sectional side view of an alternative embodiment.

The embodiment of the invention shown in FIGS. 1–6 is installed on the end portions of the wires 4 so that the ends of the wires bear against or are adjacent to the wall 40 of the wire-receiving portion of the cavity. FIG. 7 shows an alternative embodiment intended for installation on intermediate portions of wires 4. This embodiment is generally similar to the previously described embodiment except that an opening 114 is provided for each cavity in the external sidewall 20*a* and arrow shaped strain relief members, similar to the strain relief member 78 are provided by the adjacent cavities. Stiffening ribs as shown at 118 are also provided on the wall 20*a*. A connector in accordance with the embodiment of FIG. 7 can be used where it is desired to connect wires to two or more groups of terminal posts and then to provide wires extending from the terminal posts in both directions to further circuitry.

Figure 8:
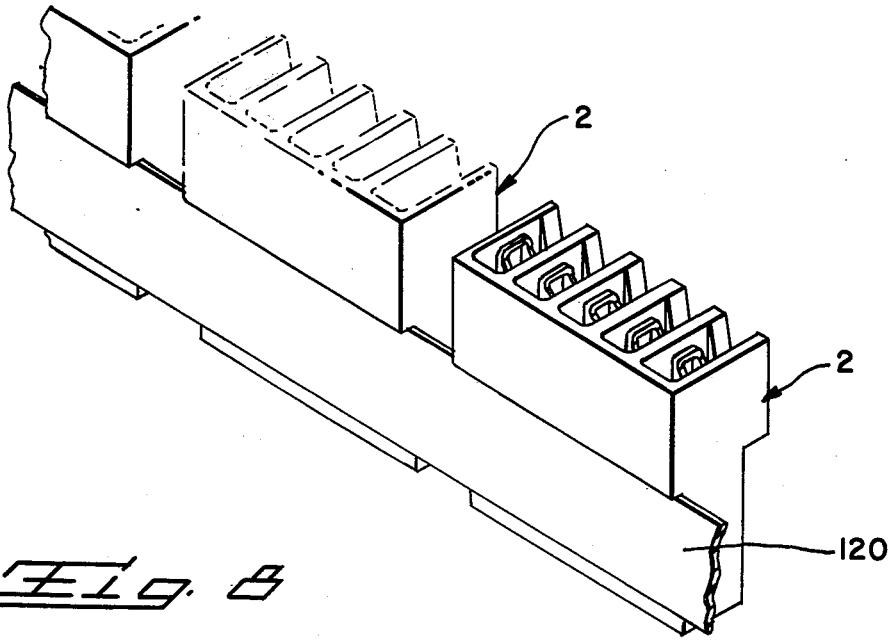
FIG. 8 is a fragmentary perspective view of a section of carrier tape having connectors in accordance with the invention mounted thereon.
Figure 9:
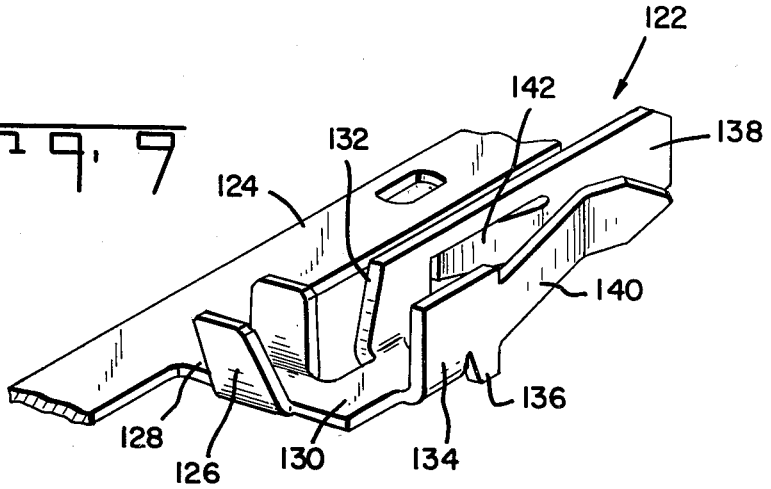
FIG. 9 is a perspective view of a crimp type terminal which can be used in the housing shown in FIGS. 1–8.
Figure 10A:
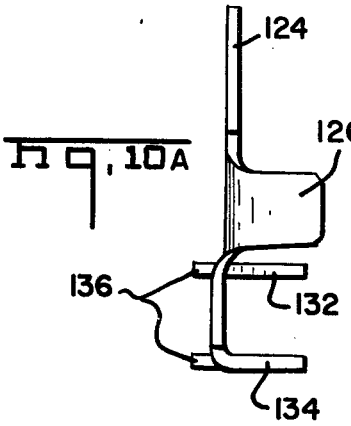
FIG. 10A is a side view of the terminal of FIG. 9.
Figure 10:
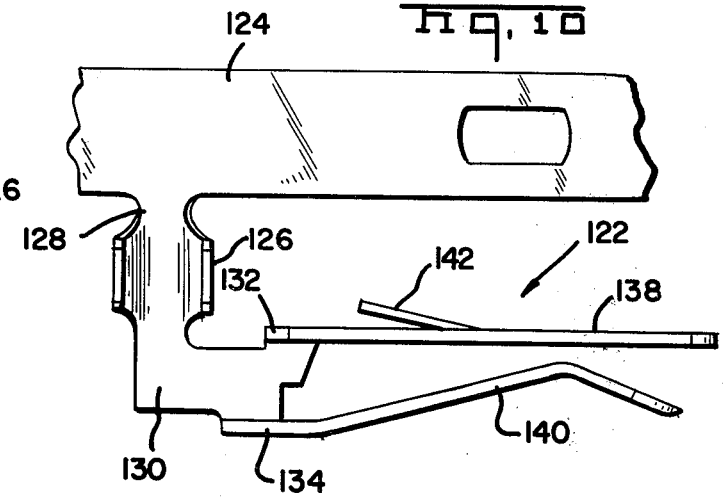
FIG. 10 is a plan view of the terminal of FIG. 9.

As shown in FIG. 8, connector in accordance with the invention can be mounted in spaced-apart relationship on a continuous carrier such as a tape 120. The individual connectors are bonded or otherwise secured to the tape at spaced-apart intervals with the tape extending over the lower portions of the external sidewall 20. The use of a carrier tape as shown in FIG. 8 provides a convenient method of storing and shipping connectors to an ultimate user and at the time of installation of the connectors on wires, the installation operations can be carried out with a suitable insertion machine of the general types known to the connector art. A machine of this type, for example, can be provided with feeding means for feeding the tape to an insertion station to locate the leading connector of the tape in alignment with wire trimming and inserting means at the insertion station. Application Ser. No. 679,961, now U.S. Pat. No. 4,043,034, shows one suitable apparatus having wire feed means and connector feeding means for feeding connectors to an insertion station.

Referring now to FIGS. 9–12, the connector housing 12 described above is also capable of receiving crimp type terminals of the type shown at 122. The terminal shown is advantageously produced in the form of a continuous strip comprising carrier strip 124 from which the terminals extend at periodic spaced apart intervals. Each terminal 122 comprises a generally U-shaped crimp portion 126 which is connected to the carrier strip 124 by a connecting neck 128 with the axis of the crimp portion extending transversely of the length of the carrier strip. A generally L-shaped web 130 extends from the base of the U-shaped crimp portion 126 and the contact portions of the terminals extend from this L-shaped web parallel to the carrier strip. The contact portion comprises contact arms 138, 140 which are substantially similar to the contact arms 100, 102 of the terminal 14 described above. The left hand ends 132, 134 of these contact arms as viewed in FIG. 10 constitute spaced-apart planar members which extend beyond the web 130 as shown at 136. These planar plate-like sections 132, 134 are received in the channels or grooves 54, 43 and they are therefore of substantially the same width as the plate-like portions 88, 90 of the terminal 14.

Figure 11:
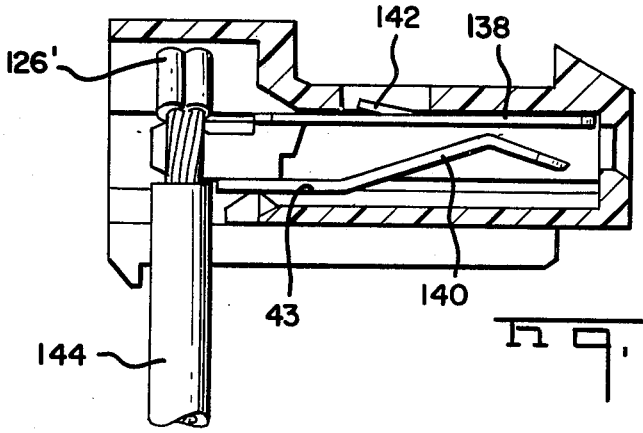
FIG. 11 is a sectional side view of a housing having terminals of the type shown in FIG. 9 contained therein.

In use, the insulation is stripped from the end portion of the wire 142 as shown at 144 and the wire is crimped onto a terminal 122. A conventional folded crimp may be used as shown at 126' and the terminal and wire are thereafter inserted into the housing cavity until the lance 142 of the terminal snaps into the opening 68 of the housing. As shown in FIG. 11, the crimped connection is accommodated in the pocket of the housing which is above the ramp 62.

There are many circumstances under which it may be desirable to use one or more crimp, snap-in type terminals in a housing 2, along with several displation type contact terminals 14. For example, there may be circumstances where the wires, for one reason or another, cannot be terminated with displation type terminations such as when a relatively coarse gage wire must be connected to a terminal post 6 along with several finer gage wires. If the coarse gage wire cannot be terminated in a displation type termination, it can be accommodated by crimping a terminal 122 onto its end and inserting this terminal into the appropriate cavity in the housing 2. As a further example, it is sometimes desirable to provide a common ground connection for shielded conductors which extend to a connector. This common ground connection can be achieved by separating the shielding material from the conductors and crimping a terminal 122 onto the shielding from several individual conductors. The individual conductors would then be inserted into terminals of the type shown at 14 in the connector and the terminal 122, to which the shielding conductors extend, would be inserted into the remaining cavity in the housing.

Suitable plastic covers may be provided on the housing 12 (FIG. 13) in order to prevent the entrance of foreign matter into the cavities of the housing and improve the strain relief for the wires extending to the terminals in the housing. The disclosed form of cover 146 comprises a generally flat plastic member having depending side walls 148, 150 with hook-like lower ends 152, 154. The cover is dimensioned such that the lower ends of the depending sides 148, 150 can be snapped over appropriately located bosses or downwardly facing surfaces on the housing, such as the strain relief members 82 shown in FIG. 2 and the downwardly facing surface 156.

What is claimed is:

1. An electrical connector comprising a housing having a plurality of contact terminals therein, said housing comprising an insulating body having a mating face, a wire-receiving face, external sidewalls, and external endwalls, said sidewalls and endwalls extending between said mating face and said wire-receiving face, a plurality of side-by-side cavities extending through said housing from said mating face to said wire-receiving face, each of said cavities having a pair of opposed internal endwalls which are parallel to said external endwalls and a pair of opposed internal sidewalls which are parallel to said external sidewalls, said internal endwalls each having a pair of parallel grooves therein extending towards said mating face, one of said external sidewalls having a plurality of wire-receiving openings therein, each of said openings communicating with one of said cavities and extending from said wire-receiving face partially along said one sidewall, each of said openings having a resilient constriction which permits movement of a wire laterally of its axis through said constriction and which prevents movement of said wire from said opening, portions of the other one of said external sidewalls adjacent to said wire-receiving face being laterally outwardly offset whereby each of said cavities has an offset pocket at said wire-receiving face, each of said terminals having conductor-connecting portions adjacent to said wire-receiving face, and each of said terminals having spaced-apart planar portions and having a contact portion, said contact portions extending from at least one of said planar portions and being proximate to said mating face, said planar portions being disposed in said grooves and being proximate to said wire-receiving face.

2. An electrical connector as set forth in claim 1, said planar portions being connected to each other by spaced-apart strap members at the ends of said planar portions which are adjacent to said wire-receiving face, said planar portions having wire-receiving slots therein which are in alignment with said openings in said sidewall whereby, wires can be connected to said terminals by moving said wires laterally of their axes, into said openings in said housing and into said slots in said terminals, and end portions of said wires will be received in said offset pockets.

3. An electrical connector as set forth in claim 1, at least one of said terminals having a crimp portion adjacent to said wire-receiving face, said crimp portion being crimped onto a wire, said planar portions being integral with, and extending from, said crimp portion, said crimp portion being received in said pocket of the associated cavity.

4. A multi-contact electrical connector which is intended to be installed on wires, said connector comprising:

an insulating housing having a mating face and a wire-receiving face, oppositely directed sidewalls and oppositely directed endwalls extending between said faces, a plurality of side-by-side contact-receiving cavities extending through said housing from said wire-receiving face to said mating face, an electrical contact terminal in each of said cavities, each of said terminals having a wire-receiving portion which is proximate to said wire-receiving face and a contact portion which is proximate to said mating face, each of said wire-receiving portions being generally U-shaped comprising a pair of spaced-apart plate-like members having corresponding ends connected by spaced-apart strap members, said plate-like members each having a wire-receiving slot therein whereby a wire can be moved laterally of its axis, between said strap members, and into said slots, said wire-receiving portion of each terminal being oriented with said plate-like members extending generally parallel to the axis of their respective cavity and with said strap portions adjacent to said wire-receiving face, each of said contact portions comprising at least one contact means which extends from one of said plate-like portions towards said mating face, said contact means being dimensioned to contact a complementary terminal device, and terminal supporting means in each of said cavities for supporting said terminal during movement of wires into said slots whereby, upon locating wires with their axes extending parallel to said wire-receiving face and in alignment with said cavities, and upon moving said wires laterally of their axes and into said wire-receiving slots of said terminals, said supporting means support said terminals against relative movement towards said mating face and said wires are connected to said terminals.

5. An electrical connector as set forth in claim 4, each of said terminal supporting means comprising shoulder means extending from opposed walls of said cavities adjacent to, and recessed from said wire-receiving face, said shoulder means having surfaces which face in the direction of said wire-receiving face and which support internal surface portions of said straps.

6. A multi-contact electrical connector comprising:

an insulating housing having a mating face and a wire-receiving face, oppositely directed sidewalls and oppositely directed endwalls extending between said faces, a plurality of side-by-side contact-receiving cavities extending through said housing from said wire-receiving face to said mating face, each of said cavities having a wire-receiving portion which is adjacent to said wire-receiving face, an electrical contact terminal in each of said cavities, each of said terminals having a wire-receiving portion which is proximate to said wire-receiving face and a contact portion which is proximate to said mating face, each of said wire-receiving portions being generally U-shaped comprising a pair of spaced-apart plate-like members having corresponding ends connected by spaced-apart strap members, said plate-like members each having a wire-receiving slot therein whereby a wire can be moved laterally of its axis, between said straps, and into said slots, said wire-receiving portion of each terminal being oriented with said plate-like members extending generally parallel to the axis of their respective cavity, and shoulder means extending from opposed walls of said wire-receiving portion of each of said cavities, said shoulder means having shoulder surfaces which face said wire-receiving face and which are opposed to internal surface portions of said straps whereby, upon locating wires with their axes extending parallel to said wire-receiving face and in alignment with said cavities, and upon moving said wires laterally of their axes and into said wire-receiving slots of said terminals, said shoulder surfaces support said terminals against relative movement towards said mating face and said wire-receiving portions of said terminals are tensionally stressed during movement of said wires without transmission of stresses to said contact portions of said terminals.

* * * * *